US006402465B1

(12) United States Patent
Maier

(10) Patent No.: US 6,402,465 B1
(45) Date of Patent: Jun. 11, 2002

(54) RING VALVE FOR TURBINE FLOW CONTROL

(75) Inventor: William C. Maier, Almond, NY (US)

(73) Assignee: Dresser-Rand Company, Olean, NY (US)

( * ) Notice: Subject to any disclaimer, the term of this patent is extended or adjusted under 35 U.S.C. 154(b) by 0 days.

(21) Appl. No.: 09/808,828

(22) Filed: Mar. 15, 2001

(51) Int. Cl.[7] ..... F01D 17/14
(52) U.S. Cl. ..... 415/159; 415/150; 137/625.15
(58) Field of Search ..... 137/625.13, 625.15, 137/625.31; 415/159, 150, 167, 183, 185, 166, 202

(56) References Cited

U.S. PATENT DOCUMENTS 2,335,085 A * 11/1943 Roberts ..... 137/625.12 X
2,389,000 A * 11/1945 Roberts ..... 137/625.12 X
3,127,909 A * 4/1964 Alamprese ..... 137/625.31
4,049,021 A * 9/1977 Fromm et al. ..... 137/625.31
5,409,351 A * 4/1995 Geist ..... 415/159
5,807,071 A * 9/1998 Brasz et al. ..... 415/150
6,015,259 A * 1/2000 Sishtla et al. ..... 415/159 X

* cited by examiner

*Primary Examiner*—John E. Ryznic
(74) *Attorney, Agent, or Firm*—Haynes and Boone, LLP

(57) ABSTRACT

A turbine includes a casing having a fluid inlet, a fluid outlet interconnected by a fluid flow path. A valve body is mounted in the casing including a plurality of flow passages within the flow path. Each passage extends from a passage inlet to a passage outlet. A control ring is movably mounted on the valve body adjacent the passage inlets. The control ring includes a plurality of openings formed therein. The openings are variably sized and variably spaced apart so that when the control ring is moved relative to the valve body, the passage inlets are closed and opened in sequence.

20 Claims, 3 Drawing Sheets

RING VALVE FOR TURBINE FLOW CONTROL

BACKGROUND

The disclosures herein related generally to fluid turbines and more particularly to a ring valve for controlling the flow of motive fluid in a turbine.

Advances in the use of valves for controlling fluid flow in a turbine have included the use of an axial grid style valve to regulate flow. In U.S. Pat. No. 3,124,931, the flow at full or partial opening is directed to the downstream flow path. However, the axial orientation of the grid valve presents significant frictional force limitations. In addition, the axial orientation has an inherent clocking or phasing limitation which requires the use of relatively thick, and therefor inefficient, nozzle vane shapes.

In U.S. Pat. No. 5,383,763, a steam turbine includes a stationary channel body having channel inlets. The channel body has at least an adapter part in which the channel inlets are formed, and a basic part having steam channels formed therein being required for conducting steam to nozzles. The channel inlets connect control slits with the steam channels and are defined in accordance with an intended control characteristic.

In U.S. Pat. No. 5,409,351, at least one roller bearing race is disposed between the stationary channel body and the rotary slide outside the vicinity of the control slits and the channel inlets, for reducing rotational friction. At least one of the control slits and at least one of the channel inlets is disposed at each of at least two separate orbits. One of the channel inlets is opened, while others of the channel inlets to be opened remain closed, upon rotation of the rotary slide in a corresponding direction of rotation.

Both of the '763 and '351 patents are related in that they describe a grid valve system especially for steam turbine use, and both disclose a valve with radially positioned ports. The '351 patent is primarily directed to the use of roller bearings in the valve to reduce pressure-induced friction. The '763 patent is directed to a two piece channel body to limit the number of customized parts required. Both of these patents disclose a typical valve system that includes large plenum-like passages connecting the valve ports and traditional axially aligned nozzle vanes. The system disclosed in both of these patents requires as much as 180° of rotation to fully open.

In U.S. Pat. No. 5,447,413, outer and inner endwall sections of a turbine are so profiled that, essentially, the flowpath is straight or flat in the direction of flow. The profiles are defined by lines of revolution about a centerline of the turbine, and shaped as projections upstream from blade tips or bases, tangent to such blade tips or bases, axially, and radially, conforming to a mean between convex and concave surfaces of the nozzle.

Therefore, what is needed is a valve for controlling the flow of motive fluid in a turbine which avoids these and further limitations of the prior art.

SUMMARY

One embodiment, accordingly, provides a valve for controlling the flow of motive fluid in a turbine and includes a movable control valve ring, a valve body with flow passages, a nozzle ring and a valve actuator. To this end, an apparatus for controlling fluid flow includes a stationary valve body including a plurality of flow passages. Each passage extends from a passage inlet to a passage outlet. A control ring is movably mounted on the valve body adjacent to and radially outwardly from the passage inlets. The control ring includes a plurality of inlets formed therein. The openings are variably sized so that when the ring is moved relative to the valve body, the passage inlets are closed and opened in sequence.

Principle advantages of this embodiment include small valve actuator forces, single case penetration for actuation, less inlet loss, a more compact embodiment, fewer parts, and a symmetrical casing. Another important benefit is that nozzle ring ports that are partially open still accelerate the steam in a useful direction, thus enhancing performance.

BRIEF DESCRIPTION OF THE DRAWING FIGURES

DETAILED DESCRIPTION

Figure 1:
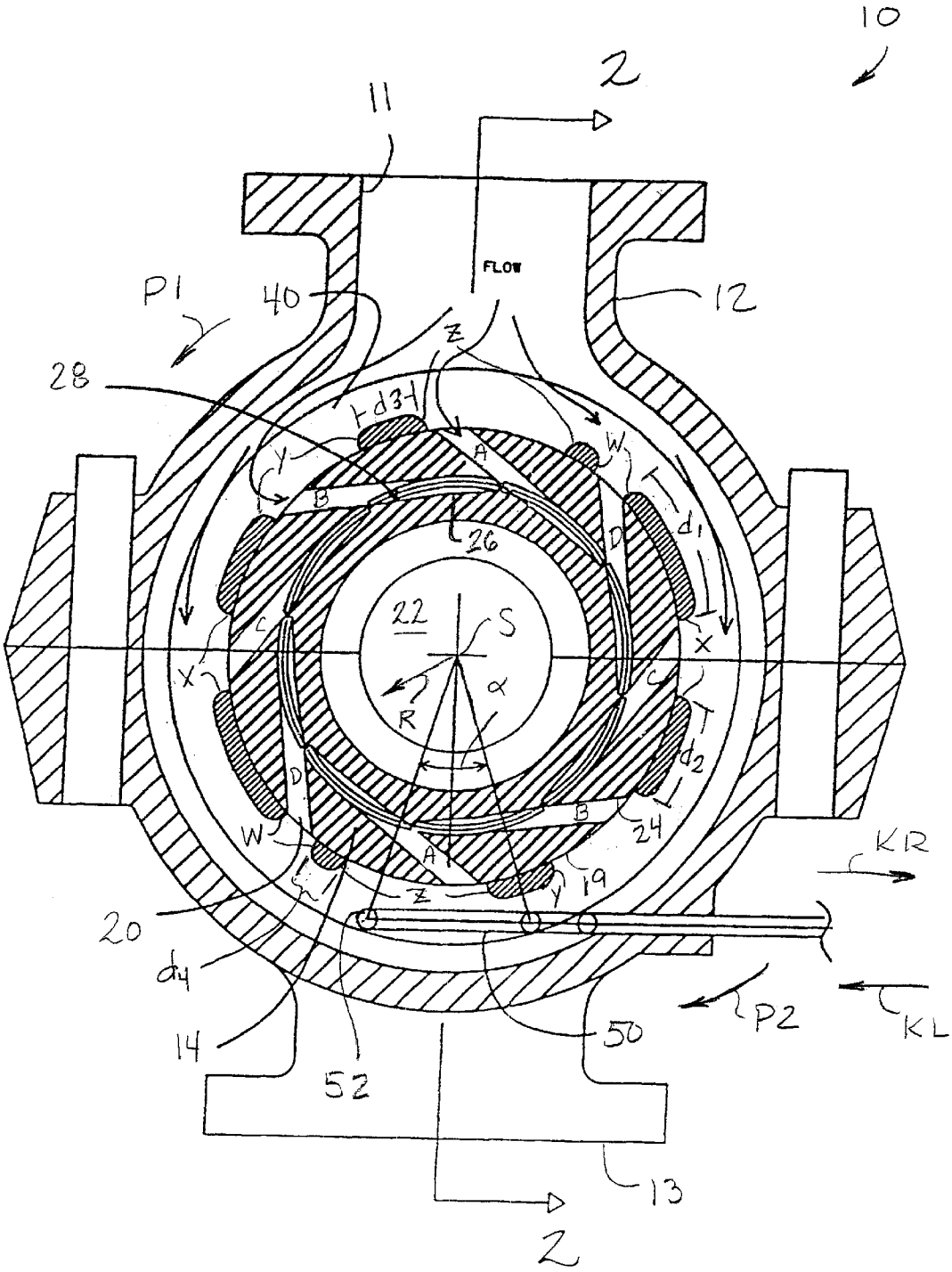
FIG. 1 is a cross-sectional end view taken along line 1—1 of FIG. 2, illustrating an embodiment of a turbine including a ring valve.
Figure 2:
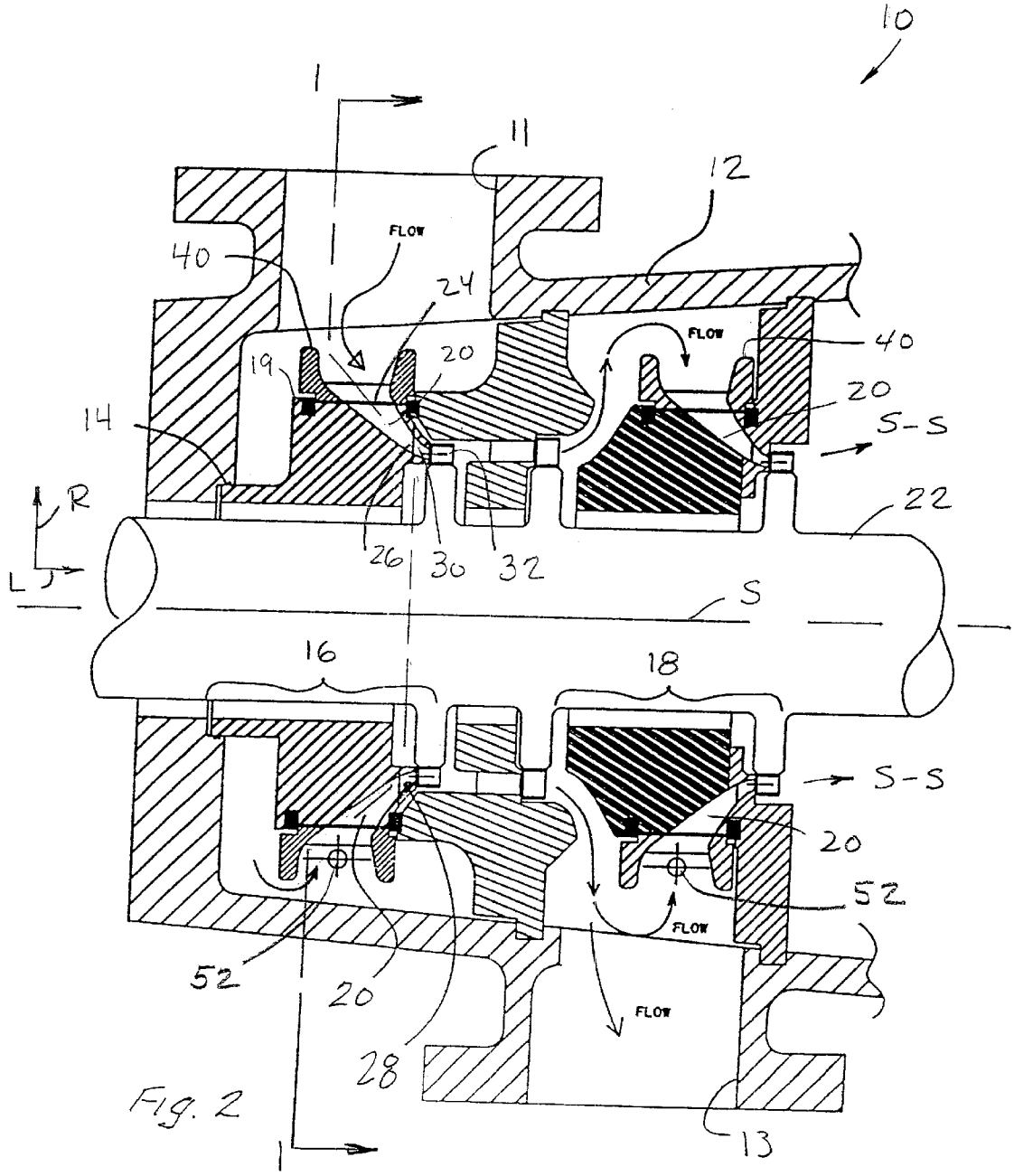
FIG. 2 is a cross-section side view taken along line 2—2 of FIG. 1.

A turbine engine is generally designated 10 in FIGS. 1 and 2, and includes a casing 12 having a turbine inlet 11 and an extraction port 13. A stationary valve body 14 is mounted in casing 12. A rotor 22 rotates about an axis S relative to the stationary valve body 14. In the configuration illustrated, engine 10 includes an inlet control stage 16 and an extraction control stage 18, best illustrated in FIG. 2. However, it is to be understood that additional stages may be included in other configurations so as to make use of the features of this disclosure.

Flow enters inlet 11 and flows through engine 10 as illustrated by a plurality of flow arrows. Flow passes through inlet control stage 16 and extraction control stage 18. Some flow may be extracted at extraction port 13, whereas some flow may pass to subsequent stages S—S as is well understood, and therefore not shown in detail.

Valve body 14 includes a plurality of passages 20 in each stage 16 and 18. Each passage 20 is diametrically opposed from another passage to provide diametrically opposed pairs of passages A—A, B—B, C—C and D—D. Each passage 20 is directed into the valve body 14 so that there is a radial component R to the direction of each passage 20, best viewed in FIG. 1, and there is also an axial component L to the direction of each passage 20, best viewed in FIG. 2. In addition, a first end or passage inlet 24 of each passage 20 is adjacent an outer surface 19 of valve body 14. A second end or passage outlet 26 of each passage 20 is adjacent a nozzle ring 28 including a plurality of stator blades 30 positioned adjacent a plurality of rotor blades 32. Second end 26 of each passage 20 is substantially tangent relative to nozzle ring 28. The passage inlets 24 are equidistantly spaced apart about the outer surface 19 of valve body 14. The radial and axial components, R, L, respectively, of the direction of the passages 20, follow along a generally tangential projection of the nozzle passages 20, between stator blades 30 in nozzle ring 28.

Figure 3:
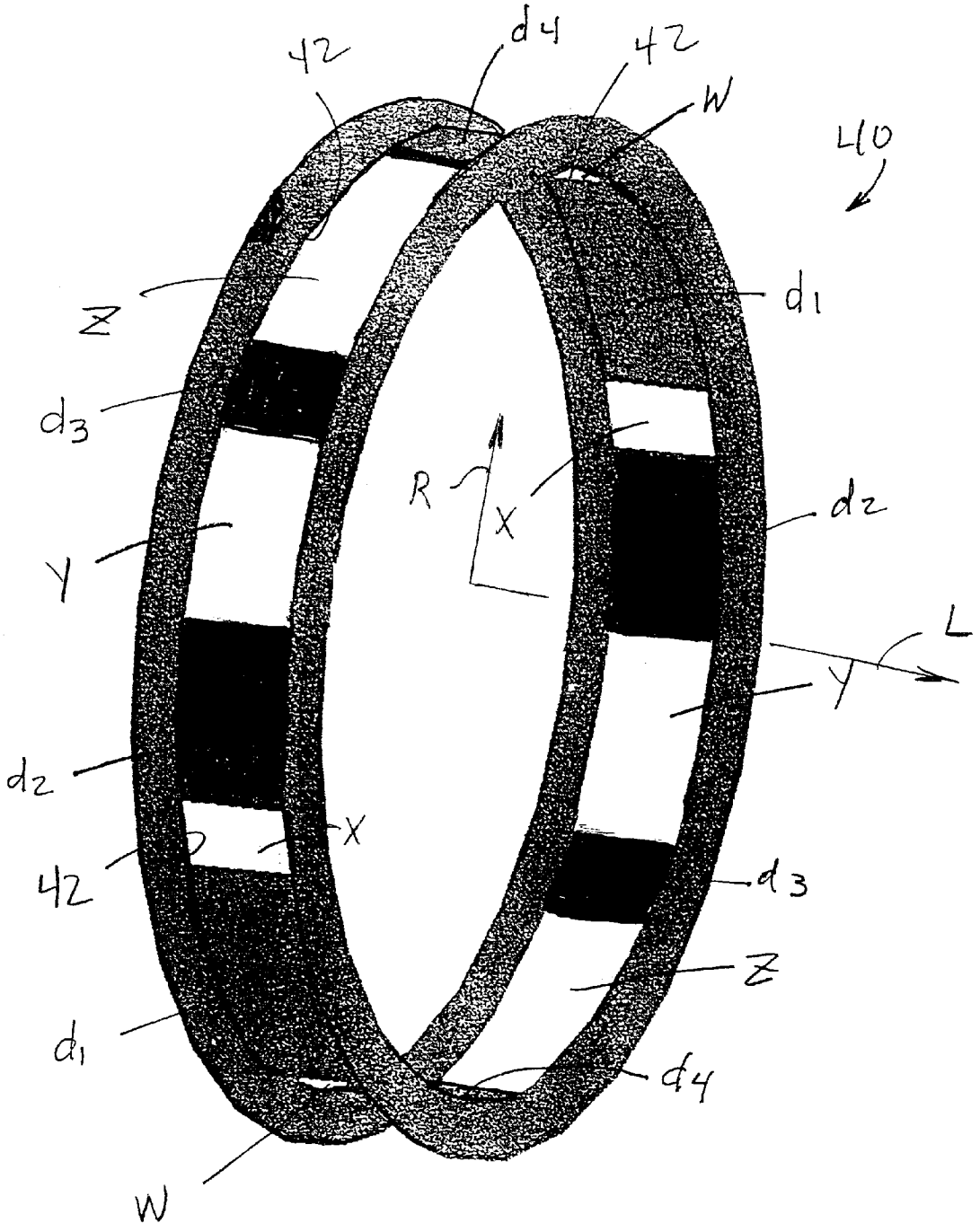
FIG. 3 is a perspective view illustrating an embodiment of a ring for the ring valve.

A control ring 40, FIGS. 1–3, is mounted on the valve body 14 adjacent the passage inlets 24 of each stage 16 and 18. Control ring 40, FIG. 3, includes a plurality of openings 42 which are of variable size and spacing therebetween. The openings 42 are disposed in the control ring 40 in diametrically opposed pairs. A pair of diametrically opposed openings W—W are of a first size, FIGS. 1 and 3. Another pair of diametrically opposed openings X—X are of a second size greater than the first size. A further pair of openings Y—Y are of a third size greater than the second size. Still another pair of openings Z—Z are of a fourth size greater than the third size. A first ring portion distance d1, FIG. 1 separates openings W and X. A second ring portion distance d2, less than d1, separates openings X and Y. A third ring portion distance d3, less than d2, separates openings Y and Z. A fourth ring portion distance d4, less than d3, separates openings Z and W.

An actuator 50 is provided to extend into casing 12 and is movable in reciprocal directions as indicated by the bi-directional arrows designated KR and KL. Actuator 50 is attached to control ring 40 at a connection 52. Movement of actuator 50 causes control ring 40 to move clockwise and counter-clockwise relative to valve body 14 as is discussed below. The range of movement of actuator 50, in this particular embodiment, is an angle of about 30°, FIG. 1.

The variable spacing between the openings 42 and the variable sizing of the openings 42 provides for the control valve 40 to open and close the passage inlets 24 in sequence when actuator 50 moves the control ring 40 relative to the valve body 14.

In operation, as best illustrated in FIG. 1, all of the passage pairs A—A, B—B, C—C and D—D are open. Movement of the actuator 50 in the direction KR, moves the control ring 40 counter-clockwise relative to valve body 14, as illustrated by the arcuate arrow P1, to sequentially close the passage pairs D—D, C—C, B—B and A—A. As a result, the open passage pair D—D is first closed by movement of ring portion d1 adjacent thereto, whereas the other passage pairs A—A, B—B and C—C remain open. Upon further movement of actuator 50 in the direction KR, the open passage pair C—C is closed by movement of ring portion d2 adjacent thereto, whereas the passage pair D—D remains closed and the other passage pairs A—A and B—B remain open. Upon still further movement of actuator 50 in the direction KR, the open passage pair B—B is closed by movement of ring portion d3 adjacent thereto, whereas the passage pairs D—D and C—C remain closed and the remaining passage pair A—A remains open. Finally, upon further movement of the actuator 50 in the direction KR, the open passage pair A—A is closed by movement of ring portion d4 adjacent thereto, such that all passage pairs A—A, B—B, C—C and D—D are closed.

By reversing movement of actuator 50 in the direction KL, opposite the direction KR, the above described sequence is reversed and the passages A—A, B—B, C—C and D—D, are sequentially opened by clockwise movement of control ring 40 in the direction designated by the arcuate arrow P2, relative to valve body 14.

As a result, one embodiment provides an apparatus for controlling fluid flow including a stationary valve body including a plurality of flow passages, each passage extending from a passage inlet to a passage outlet. A control ring is movably mounted on the valve body adjacent the passage inlets. The control ring includes a plurality of openings formed therein. The openings are variably sized so that when the control ring is moved relative to the valve body, the passage inlets are closed and opened in sequence.

Another embodiment provides a turbine including a casing having a fluid inlet, a fluid outlet and a fluid flow path therebetween. A valve body is mounted in the casing including a plurality of flow passages within the flow path. Each passage extends from a passage inlet to a passage outlet. A control ring is movably mounted on the valve body adjacent the passage inlets. The control ring includes a plurality of openings formed therein. The openings are variably sized so that when the control ring is moved relative to the valve body, the passage inlets are closed and opened in sequence.

A further embodiment provides an apparatus for turbine flow control including a casing having a fluid inlet, a fluid outlet and a fluid flow path therebetween. A valve body is mounted in the casing including a plurality of adjacent pairs of diametrically opposed flow passages within the flow path. Each passage extends from a passage inlet to a passage outlet. A control ring is movably mounted on the valve body adjacent the passage inlets. The control ring includes a plurality of adjacent pairs of diametrically opposed openings formed therein. Each pair of openings is of a different size from each other pair of openings and is also variably spaced from each other pair of openings, so that when the control ring is moved relative to the valve body, each pair of passage inlets are closed and opened in sequence.

As it can be seen, the principal advantages of this embodiment include small valve actuator forces, single case penetration for actuation, less inlet loss, a more compact embodiment, fewer parts, and a symmetrical casing. Another important benefit is that nozzle ring ports that are partially open still accelerate the steam in a useful direction, thus enhancing performance. This embodiment is more similar to a variable area control system than more traditional variable pressure systems. This eliminates the need for custom designing the nozzling of control stages. A single standard embodiment could be used on all multi-valve turbines, and could also make the distinction between multi-valve and single valve turbine control systems moot.

In view of the foregoing, it is apparent that the present disclosure provides that the flow at full or partial opening is directed to the downstream flow path. Specifically arranged connecting passages in combination with vane profiles, direct the fluid from the valve discharge area to the nozzle discharge region. The passages have smooth variations in cross-section with few bends or turns. This permits the use of smaller passages which provide compactness, facilitate clocking or phasing and increase turbine efficiency. As a result, it is possible to provide complete valve opening, including staggered opening of nozzle groups with relatively small rotational movement, typically about 30 degrees. Thus, the present system minimizes throttling loss by directing the high velocity fluid jet, discharging from the valve, towards the first rotating blade row.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. Apparatus for controlling fluid flow comprising:

a stationary valve body including a plurality of flow passages, each passage extending from a passage inlet to a passage outlet; and a control ring movably mounted on the valve body adjacent to and radially outwardly from the passage inlets, the control ring including a plurality of openings formed therein, the openings being variably sized so that when the ring is moved relative to the valve body, the passage inlets are closed and opened in sequence.

2. The apparatus as defined in claim 1 wherein each passage extends axially and radially into the valve body.

3. The apparatus as defined in claim 2 wherein the openings are variably spaced apart.

4. The apparatus as defined in claim 1 wherein the passages are disposed in the valve body in diametrically opposed pairs.

5. The apparatus as defined in claim 4 wherein the openings are disposed in the control ring in diametrically opposed pairs.

6. The apparatus as defined in claim 5 wherein each pair of openings is a different size from each other pair of openings.

7. The apparatus as defined in claim 6 wherein each pair of openings is variably spaced from each other pair of openings.

8. The apparatus as defined in claim 3 further comprising an actuator for moving the control ring relative to the valve body.

9. A turbine comprising:

a casing having a fluid inlet, a fluid outlet and a fluid flow path therebetween;

a valve body mounted in the casing including a plurality of flow passages within the flow path, each passage extending from a passage inlet to a passage outlet; and a control ring movably mounted on the valve body adjacent to and radially outwardly from the passage inlets, the control ring including a plurality of openings formed therein, the openings being variably sized so that when the control ring is moved relative to the valve body, the passage inlets are closed and opened in sequence.

10. The turbine as defined in claim 9 wherein each passage extends axially and radially into the valve body.

11. The turbine as defined in claim 10 wherein the openings are variably spaced apart.

12. The turbine as defined in claim 9 wherein the passages are disposed in the valve body in diametrically opposed pairs.

13. A turbine as defined in claim 12 wherein the openings are disposed in the control ring in diametrically opposed pairs.

14. The turbine as defined in claim 13 wherein each pair of openings is a different size from each other pair of openings.

15. The turbine as defined in claim 14 wherein each pair of openings is variably spaced from each other pair of openings.

16. The turbine as defined in claim 11 further comprising an actuator for moving the control ring relative to the valve body.

17. The turbine as defined in claim 9 further comprising a stationary nozzle ring having a plurality of stator blades adjacent the passage outlets.

18. The turbine as defined in claim 17 further comprising a rotor rotatably mounted in the casing and including a plurality of rotor blades adjacent the stator blades.

19. The turbine as defined in claim 18 wherein each passage is substantially tangential with respect to the nozzle ring.

20. Apparatus for turbine flow control comprising:

a casing having a fluid inlet, a fluid outlet and a fluid flow path therebetween;

a valve body mounted in the casing including a plurality of adjacent pairs of diametrically opposed flow passages within the flow path, each passage extending from a passage inlet to a passage outlet; and a control ring movably mounted on the valve body adjacent to and radially outwardly from the passage inlets, the control ring including a plurality of adjacent pairs of diametrically opposed openings formed therein, each pair of openings being of a different size from each other pair of openings and also being variably spaced from each other pair of openings, so that when the control ring is moved relative to the valve body, each pair of passage inlets are closed and opened in sequence.

* * * * *